US005241135A

United States Patent [19]

Fetzer

[11] Patent Number: 5,241,135

[45] Date of Patent: Aug. 31, 1993

[54] CONNECTOR GROUNDING TERMINAL

[75] Inventor: Barry A. Fetzer, Seattle, Wash.

[73] Assignee: The Boeing Company, Seattle, Wash.

[21] Appl. No.: 806,397

[22] Filed: Dec. 13, 1991

[51] Int. Cl.[5] ..... H01R 9/05

[52] U.S. Cl. ..... 174/88 R; 174/75 C; 174/78; 174/88 C; 174/94 R; 439/98; 439/579; 439/580; 439/610

[58] Field of Search ..... 174/75 C, 78, 88 R, 174/88 C, 94 R; 439/94, 98, 99, 579, 580, 610

[56] References Cited

U.S. PATENT DOCUMENTS 3,513,433 5/1970 Carroll ..... 439/579
3,569,900 3/1971 Uberbacker ..... 439/579 X
4,243,290 1/1981 Williams ..... 439/610
4,365,856 12/1982 Yaegashi et al. ..... 439/579 X

FOREIGN PATENT DOCUMENTS 872449 6/1971 Canada ..... 439/98
881013 11/1961 United Kingdom ..... 439/98

*Primary Examiner*—Morris H. Nimmo
*Attorney, Agent, or Firm*—Conrad O. Gardner; B. A. Donahue

[57] ABSTRACT

A brass strap is utilized as a common grounding bar for the shields of a plurality of coaxial cables. The individual coaxial cables pass through holes in the common grounding bar, and the inner conductors are connected to the pins of a printed circuit board connector.

2 Claims, 1 Drawing Sheet

CONNECTOR GROUNDING TERMINAL

The present invention relates to a printed circuit board connector grounding terminal and, more particularly, to a grounding terminal for a plurality of coaxial cables.

BACKGROUND

When a coaxial cable is connected to a connector, two pins must be used. The first pin is tied to the signal wire, and the second pin is tied to the shield surrounding the signal wire. The shield pin is usually distributed to ground on the printed circuit board. Because two pins on the printed circuit board via connector are consumed by one coaxial wire, the amount of circuitry that can be linked from the printed circuit board to the system is severely limited. For example, a standard board has 44 pins, subtracting power and ground, the amount of signal wires that can go to the board is 42. If these signal wires need to be distributed through coaxial cable, the amount of signal wires that can go to the board is now 21. So now the printed circuit board is limited by the amount of coaxial wires that can go to it and not by the amount of circuitry that can be fit onto it.

Heretofore, the shields of a few coaxial cables were doubled or tripled up and then soldered to a grounding pin. Also, this approach for grounding a plurality of coaxial cables was awkward for the technicians who wired the system chassis and not reliable for integrity purposes.

The prior art patent literature shows various methods for grounding to a common board or chassis, and exemplary thereof is U.S. Pat. No. 3,513,433 to Carroll showing a grounding bar to which wires from each shield are soldered, requiring an added soldering step for each shield.

SUMMARY OF THE INVENTION

This invention is directed to improvements in connecting coaxial cables to printed circuit boards, and especially to a ground system for a plurality of shield Portions for the coaxial cables.

Accordingly, a feature of the present invention is to provide a means for decreasing by half the number of traces passing through a printed circuit board connector when a plurality of coaxial cables are utilized in transmitting signals to a printed circuit board.

According to a preferred embodiment of the invention, an apertured grounding bar is disposed in predetermined, spaced-apart relationship with respect to a multiple pin circuit board connector. A plurality of coaxial cables are passed through a respective plurality of apertures with the outer ground shield portions soldered to the grounding bar while the center conductors are soldered to the multiple pins of the circuit board connector.

DESCRIPTION OF THE PREFERRED EMBODIMENT

The present connector grounding terminal 10 comprises an electrically conductive strap member 12 made of e.g. 0.035 inch thick sold brass mounted on a multiple-pin connector 14, e.g. a 44-pin cinch connector, identified as No. 2512230160 and made by TRW Company.

Figure 1:
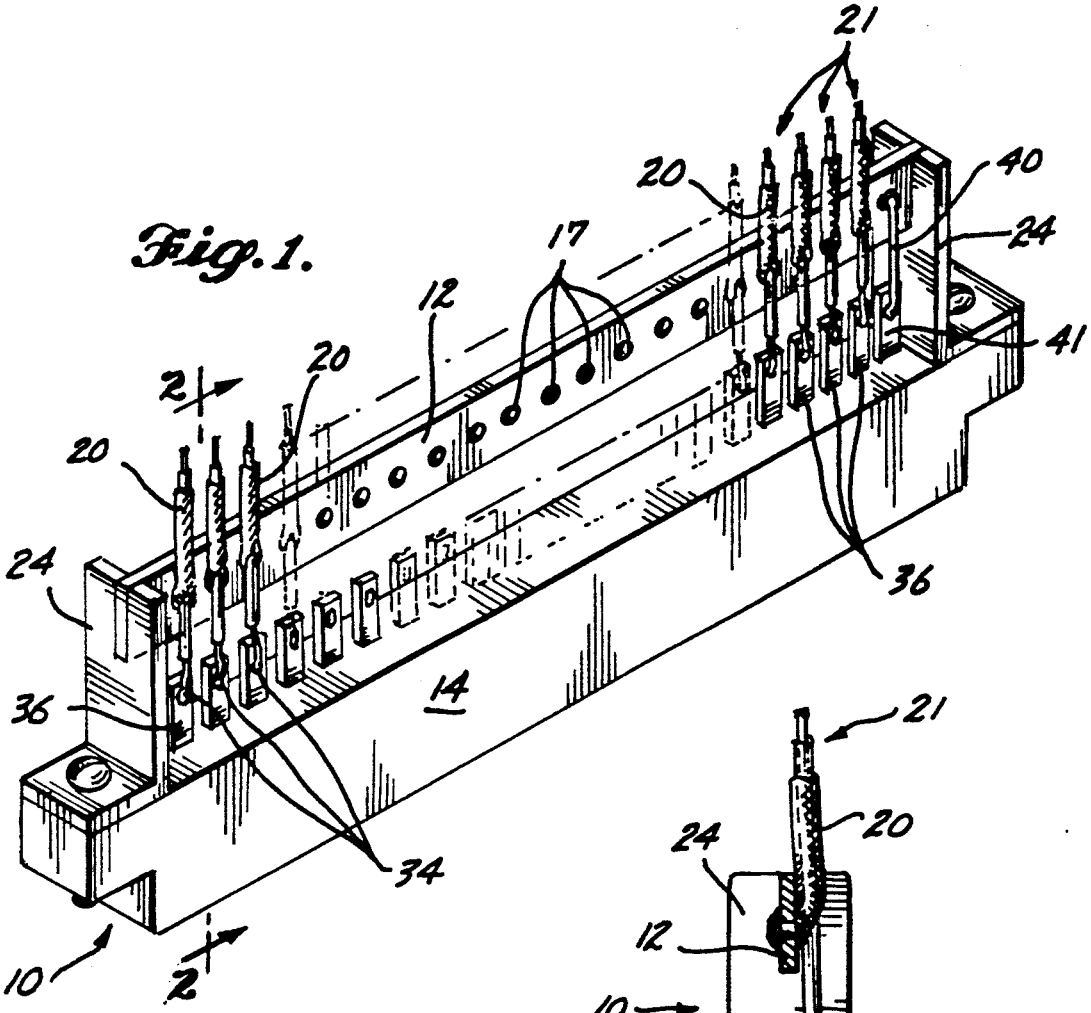
FIG. 1 is a perspective view of a multiple-pin connector grounding terminal for coaxial cables in accordance with the present invention.
Figure 2:
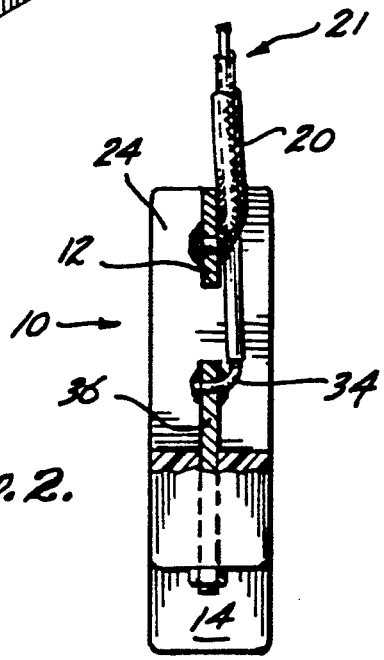
FIG. 2 is a sectional view of the present multiple-pin connector grounding terminal taken along the lines 2—2 of FIG. 1 showing in more detail coaxial cable ground and pin connections.

Connector grounding terminal 10 includes a plurality of evenly spaced apertures 17 distributed along electrically conductive strap member 12, so that the outer shield portions 20 of coaxial cables 21 can be passed through apertures 17 and soldered to electrically conductive strap member 12. A pair of L-shaped brackets 24 support electrically conductive strap member 12 upon multiple-pin connector 14. The inner conductors 34, which comprise the signal carrying wires, are then soldered to pins 36. of multiple-pin connector 14. A grounding wire 40, as seen in FIG. 1, has one end thereof soldered to a pin 41 of multiple-pin connector 14, and the other end soldered to electrically conductive strap member 12.

Although the invention has been shown and described with respect to a preferred embodiment, it is obvious that equivalent alterations and modifications will occur to others skilled in the art upon the reading and understanding of the specification. The present invention includes all such equivalent alterations and modifications, and is limited only by the scope of the following claim.

What is claimed is:

1. A printed circuit board connector for coupling a plurality of coaxial cables to the printed circuit board, said coaxial cables having outer shields and inner conductors, the printed circuit board connector comprising in combination:

a multiple- pin connector;

an electrically conductive common grounding bar attached to said multiple-pin connector;

said electrically conductive common grounding bar having a plurality of apertures distributed therealong;

said outer shields of a plurality of coaxial cables extending through said plurality of apertures and soldered to said electrically conductive common grounding bar;

said inner conductors of said plurality of coaxial cables soldered to a plurality of pins of said multiple-pin connector; and a grounding wire having one end electrically connected to a pin of said multiple-pin connector and the other end electrically connected to said electrically conductive common grounding bar.

2. Apparatus for coupling a plurality of coaxial cables to a printed circuit board, said coaxial cables having outer shields and inner conductors, the apparatus comprising in combination:

a multiple-pin connector having a plurality of pins to which inner conductors of a plurality of coaxial cable join;

an electrically conductive common grounding bar to which outer shields of said coaxial cables join, said electrically conductive common grounding bar attached to said multiple-pin connector;

said electrically conductive common grounding bar having a plurality of apertures distributed therealong through which said outer shields extend; and a grounding wire having one end electrically connected to a pin of said multiple-in connector and the other end electrically connected to said electrically connected common grounding bar.

* * * * *